US005478218A

United States Patent [19]

Gu

[11] Patent Number: 5,478,218

[45] Date of Patent: Dec. 26, 1995

[54] ROTATING-CYLINDER COMPRESSOR

[76] Inventor: Inhoy Gu, 420-503 Doonchon Apt. Doonchon-dong, Gangdong-gu, Seoul, Rep. of Korea

[21] Appl. No.: 328,863

[22] Filed: Oct. 25, 1994

[30] Foreign Application Priority Data

Mar. 23, 1994 [KR] Rep. of Korea ..... 1994-5791

[51] Int. Cl.[6] ..... F04B 27/06

[52] U.S. Cl. ..... 417/462; 92/72

[58] Field of Search ..... 417/462, 463, 417/515, 466, 572, 464; 92/72; 418/265

[56] References Cited

U.S. PATENT DOCUMENTS 3,521,533 7/1970 Avermaete ..... 92/58
3,799,035 3/1974 Lamm ..... 417/462
4,030,458 6/1977 Lamm ..... 417/462
4,106,443 8/1978 Triulzi ..... 92/54
4,936,111 6/1990 Wilkinson et al. ..... 417/462

*Primary Examiner*—Richard A. Bertsch
*Assistant Examiner*—Peter G. Korytnyk
*Attorney, Agent, or Firm*—Ladas & Parry

[57] ABSTRACT

A rotary gas compressor and vacuum pump apparatus which utilizes a central rotor with a slot formed therein to slidably receive a piston eccentrically connected onto a disk which covers the slot to form a cylinder is disclosed. The distance between the rotor axis and disk axis is equal to the distance between the disk axis and the off-center shaft axis, with all axes being parallel. Upon rotation of the disk, the rotor rotates at one-half the rotational velocity of the disk causing the piston to reciprocate in the cylinder, with gas flowing into the increasing cylinder volume and being compressed and discharged in the decreasing cylinder volume. This cyclic process continues with continued rotation of the central rotor.

20 Claims, 7 Drawing Sheets

ROTATING-CYLINDER COMPRESSOR

BACKGROUND OF INVENTION

1. Field of the Invention

This invention relates to an apparatus for compressing gas and for creating a vacuum, and more particularly to a structure which includes a rotor assembly having at least one cylinder in which a piston operatively connected to a rotating disk, reciprocates as a powered disk rotates about an axis parallel but eccentric to the rotor axis to enable gas drawn into the cylinder to be pressurized by the reciprocating piston or to be removed from a vessel to create a vacuum.

2. Information Disclosure Statement

Positive-displacement compressors for pressurizing gas are of two types: rotary and reciprocating. The reciprocating compressors are equipped with a piston in a cylinder and the inlet and outlet valves which necessitate a clearance volume between the piston head and cylinder head. This clearance volume lowers the volume efficiency of the compressors. These compressors can be single or double-acting compressors in which suction and compression take place on each side of the piston. The piston-crankshaft mechanism results in vibration due to a reciprocating mass center. Such compressors are usually suited for high-pressure low-volume services. The rotary compressors, on the other hand, compress gas by way of rotating shaft driving rotating elements. The sliding-vane and screw compressors are of this type, with no valves for the inlet and outlet of gas in a fixed-compression ratio. The high and low pressure cylinders in the rotary compressors are separated by a contact line compared to a contact area in the reciprocating type. Thus leakage is more likely in the linecontact type than in the area-contact type. High pressure cannot be obtained with a single-stage line-contact rotary compressor. Also, conventional rotary compressors are not operative at very low speeds.

Therefore, it is a primary object of the present invention to provide a a rotary compressor in which the separation between high and low pressure cylinders is made by the area-contact surfaces, to produce a high compression ratio in a single stage.

It is a further object of the present invention to provide a double-acting cylinder compressor with no valves in a fixed compression ratio.

It is a further object of the present invention to provide a rotary compressor in which compression ratio can be varied according to the pressure difference of the compressed volume and outlet port.

It is a further object of the present invention to provide a rotary compressor which is operative at very low rotational speeds.

The preceding objects should be construed as merely presenting a few of the more pertinent features and applications of the invention. Many other beneficial results can be obtained by applying the disclosed invention in a different manner or modifying the invention within the scope of the disclosure. Accordingly, other objects and a fuller understanding of the invention may be had by referring to both the summary of the invention and the detailed description, below, which describe the preferred embodiment in addition to the scope of the invention defined by the claims considered in conjunction with the accompanying drawings.

SUMMARY OF THE INVENTION

The present invention utilizes the kinematics of two rotating circles with radius ratio 1:2 with the small circle contacting the inside of the large circle so that they have a same velocity at the contact point. In this case a point on the small circle makes a reciprocating motion on a diameter fixed to the large circle. Thus the rotational motion of the circumference point of the small circle becomes a linear motion with respect to the rotating large circle.

Thus, a slot is formed along the diameter of a central rotor and a piston is eccentrically secured to a rotating disk which covers the slot. The slot covered with the disk defines a cylinder in which the piston reciprocates upon rotation of the disk. Gas flows into the cylinder on one side of the piston, and at the same time the gas on the other side of the piston is compressed and discharged.

As the central rotor and the cylinder rotate, the cyclic process is continued with suction, compression and discharge. Thus, during one revolution of the disk the central rotor makes one-half revolution, producing gas compression of one cylinder volume. The compression ratio is adjusted by the angular position of the discharge opening. No valves are necessary for a constant compression ratio. However, when a flapping plate valve having an arc shape is installed on the discharge side in close clearance with the rotor, the compression ratio can be varied, since the compressed gas is discharged as the gas pressure in the cylinder is higher than that of the outlet port.

A primary advantage of the present invention is that leakage is minimized due to the area-contact separation of the spaces of different pressures. Moreover, the volume efficiency is high with zero clearance volume, so that all of the suctioned gas is compressed and discharged during the cycle. Furthermore, the compressor of the present invention has no reciprocating mass since all the moving elements are in a circular motion in an absolute terms, which results in quiet operation. Additionally, compared to the other rotary compressors, the design of each of necessary parts is simple.

The structure of the present invention is defined by the claims with specific embodiments shown in the attached drawings. For the purpose of summarizing the invention, the invention relates to a compressor apparatus comprising a central rotor 10 having a rotational axis $O_1$, a first face 10A and a second face 10B with an open ended slot 17, 18 formed perpendicular to the axis $O_1$ in each face 10A, 10B. A first disk 11 and a second disk 12 are used with each disk having an axis $O_2$ spaced apart and parallel to the axis $O_1$ of the central rotor 10. Each disk includes a front surface 11A, 12A and a back surface 11B, 12B which, in use, are in sliding contact with the first face 10A and the second face 10B of the central rotor 10, respectively, such that each open-ended slot defines a cylinder 17A, 18A having open ends 17B, 17BB; 18B, 18BB, respectively. An off-center shaft 13, 14 is eccentrically positioned relative to the respective disk axis, on the back surface 11B, 12B of each disk 11, 12. A first piston 15 and a second piston 16 with a bore 23, 24 formed in each piston to receive therein one of the off-center shafts 13, 14 of the first and second disk, respectively, are used. Each first and second piston is slidably received into its respective cylinder 17A, 18A which together with the central rotor defines a rotor assembly. That is, the rotor assembly comprises the central rotor 10 and the cylinders and the pistons therein when operationally mounted between the disks 11, 12. Thus, in use, upon rotating at least one of the disks, the corresponding off-center shaft revolves about the axis of the disk forcing the corresponding piston to slidably reciprocate within its cylinder. The piston also exerts rotational force on the central rotor 10 causing it to rotate about its axis $O_1$. The disks may be rotationally powered by, for example, a center shaft axially formed on the front surface of at least one disk to receive rotational input from an electric motor or the like. Case 31 operatively encloses the rotor assembly. The case includes an arced wall 20A dividing the case into an inlet port 29 and an outlet port 30 and which partially encloses the rotor assembly yet allows gaseous communication of the cylinder(s) with the inlet and outlet ports. The arced wall further includes at least one opening formed therein for gas to be discharged into the outlet port during the discharge phase and the central rotor is positioned so as to allow gaseous intake from the inlet port during the intake phase. Thus, upon rotation of at least one of the disks about its respective axis $O_2$, the central rotor is rotated about its respective axis $O_1$ to expose one of the open ends of the corresponding cylinder to the intake port whereat the corresponding piston moves within the cylinder to enable gas present in the intake port 29 to be withdrawn into the cylinder and upon further rotation of the central rotor, the arced wall covers the open end of cylinder exposed to the intake port and the piston moves to pressurize the gas within the cylinder to a pressure of a constant compression ratio and upon further rotation, moving the cylinder to the opening formed in the arced wall and to enable the pressurized gas to pass through the opening 26A in the arced wall partially enclosing the rotor assembly and into the output port and upon further rotation the arced wall 20A covers the open end of the cylinder to prevent backflow from the output port to the inlet port.

In another embodiment, an arced wall 20A dividing the case into an inlet port 29 and an outlet port 30 is partially enclosing the rotor assembly. The arced wall includes an arc valve seat 27 having a plurality of openings 28 formed therein to enable gas passage into the outlet port. A flapping plate valve 33 with a plurality of openings 35 formed therein is positioned over the arc valve seat 27. In use, the flapping plate valve 33 is in pressured contact with the arc valve seat 27 of the arced wall 20A and thereby occludes the plurality of openings formed in the arc valve seat 27. Thus, upon rotation of at least one of the disks, the central rotor is rotated to expose one of the open ends of the cylinder to the intake port to enable the corresponding piston to move within the cylinder to enable withdrawal of gas from the intake port 29 into the cylinder and upon further rotation of the central rotor, covering the open end of the cylinder exposed to the intake port and moving the piston to compress the gas within the cylinder to a pressure greater than existing pressure of the outlet port 30 exerted on the flapping plate valve 33 thereby forcing the flapping plate valve to move away from the arc valve seat 27 causing the compressed gas to pass through the plurality of openings formed in the flapping plate valve and into the outlet port and upon further rotation the arced wall 20A covers the open end of the cylinder to prevent backflow from the output port to the inlet port.

The more pertinent and important features of the present invention have been outlined above in order that the detailed description of the invention which follows will be better understood and that the present contribution to the art can be fully appreciated. Additional features of the invention described hereinafter from the subject of the claims of the invention. Those skilled in the art can appreciate that the conception and the specific embodiment disclosed herein may be readily utilized as a basis for modifying or designing other structures for carring out the same purposes of the present invention. Further, those skilled in the art can realize that such equivalent constructions do not depart from the spirit and scope of the invention as set forth in the claims.

BRIEF DESCRIPTION OF THE DRAWINGS

For fuller understanding of the nature and objects of the invention, reference should be had to the following detailed description taken in conjunction with the accompanying drawings in which.

Similar reference characters refer to similar parts throughout the several views of the drawings.

DETAILED DESCRIPTION OF THE INVENTION

Figure 1:
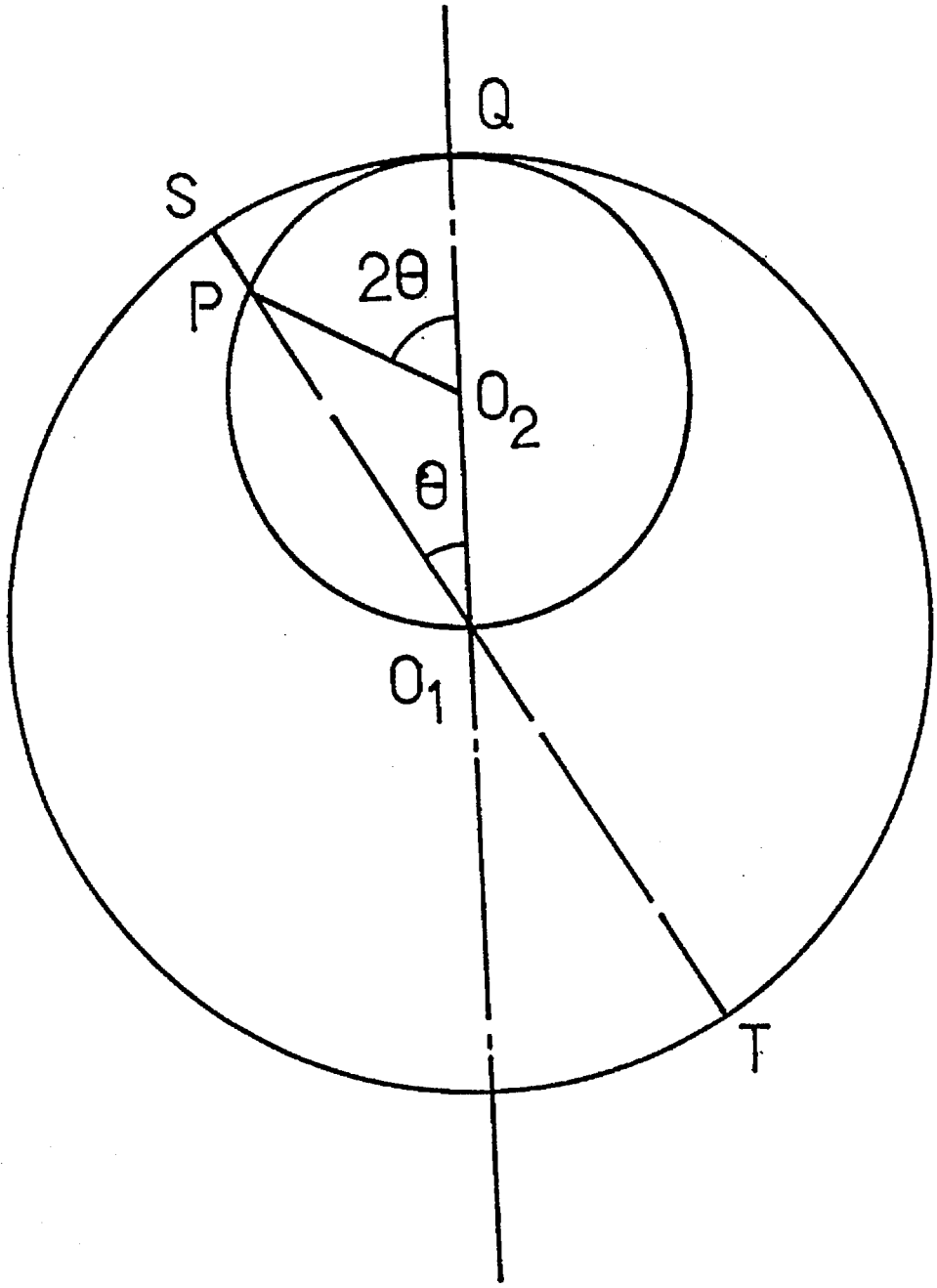
FIG. 1 shows the kinematic motion utilized in the present invention.

FIG. 1 illustrates the plane kinematics utilized in the present invention. A large circle centered at $O_1$ has a radius equal to the diameter of a small circle centered at $O_2$. The two contacting circles rotates about each center with no slippage at the contacting point Q, so the small circle has an angular velocity two times greater than the large circle. Thus the small circle makes a rotation of an angle $2\theta$ while the large circle rotates an angle $\theta$. Then a point P on the circumference of the small circle is always positioned on the diameter ST fixed to the large circle, regardless of the rotation angle $\theta$. In other words, the point P rotating about the center $O_2$ makes a liner motion with respect to the line ST rotating about the center $O_1$.

In the present invention the cylinder of the rotor is placed along the diameter ST of a rotor centered at the point $O_1$ and a piston placed at the point P which rotates about the point $O_2$. As discussed, the cylinder is a slot covered with a rotating disk, to which the piston is connected away from the disk center $O_2$. The rotation of the disk rotates the slotted rotor as well as reciprocates the piston within the cylinder. Therefore, continuous reciprocating motion is generated without the aid of a crank mechanism. That is, neither a conventional crank shaft nor a conventional connecting rod is needed in the apparatus of the present invention. In FIG. 1, ST is the stroke length, i.e. the length of piston movement in the cylinder with a half revolution of the central rotor, and is equal to four times the length $O_1O_2$.

FIG. 1 shows an exploded view of the major components of one embodiment of the present invention. The central rotor 10 has an axis $O_1$, a first face 10A and a second face 10B. An open ended slot 17, 18 is formed in each face 10A, 10B perpendicular to the axis of the rotor 10. There is no gaseous communication between the slots formed on the opposite sides of the central rotor 10. Even though the slots are shown to be positioned at a right angle to each other, they may be formed at any angle relative to each other. The pistons 15, 16 are placed in each slot 17, 18 and are in the sliding contact along the respective slot wall surface. The slot and its mating piston have a same cross section normal to the slot axis. Each piston 15, 16 has a bore 23, 24 formed therein in the axial direction of the central rotor 10. The bore 23, 24 is located so that its axis intersects the diameter of the central rotor on the slot axis. On each side of the central rotor, the first and second disk 11, 12 are operatively positioned by inserting the corresponding off-center shaft 13, 14 into the corresponding piston bore 23, 24. Close clearance is maintained between the round off-center shaft and its mating bore. Each off-center shaft 13, 14 is eccentrically positioned on the back surface 11B, 12B of the disk from the rotational center (axis $O_2$) of each disk, and the eccentricity is one quarter of the piston stroke in the cylinder. That is, each piston travels a predetermined length (stroke) within its cylinder and the off-center shaft is positioned a distance of one-fourth of the stroke length from the axis $O_2$ of each disk, respectively. Also, the distance between the rotor axis and disk axis is equal to the distance between the disk axis and off-center shaft axis, with all axes being parallel.

Figure 2:
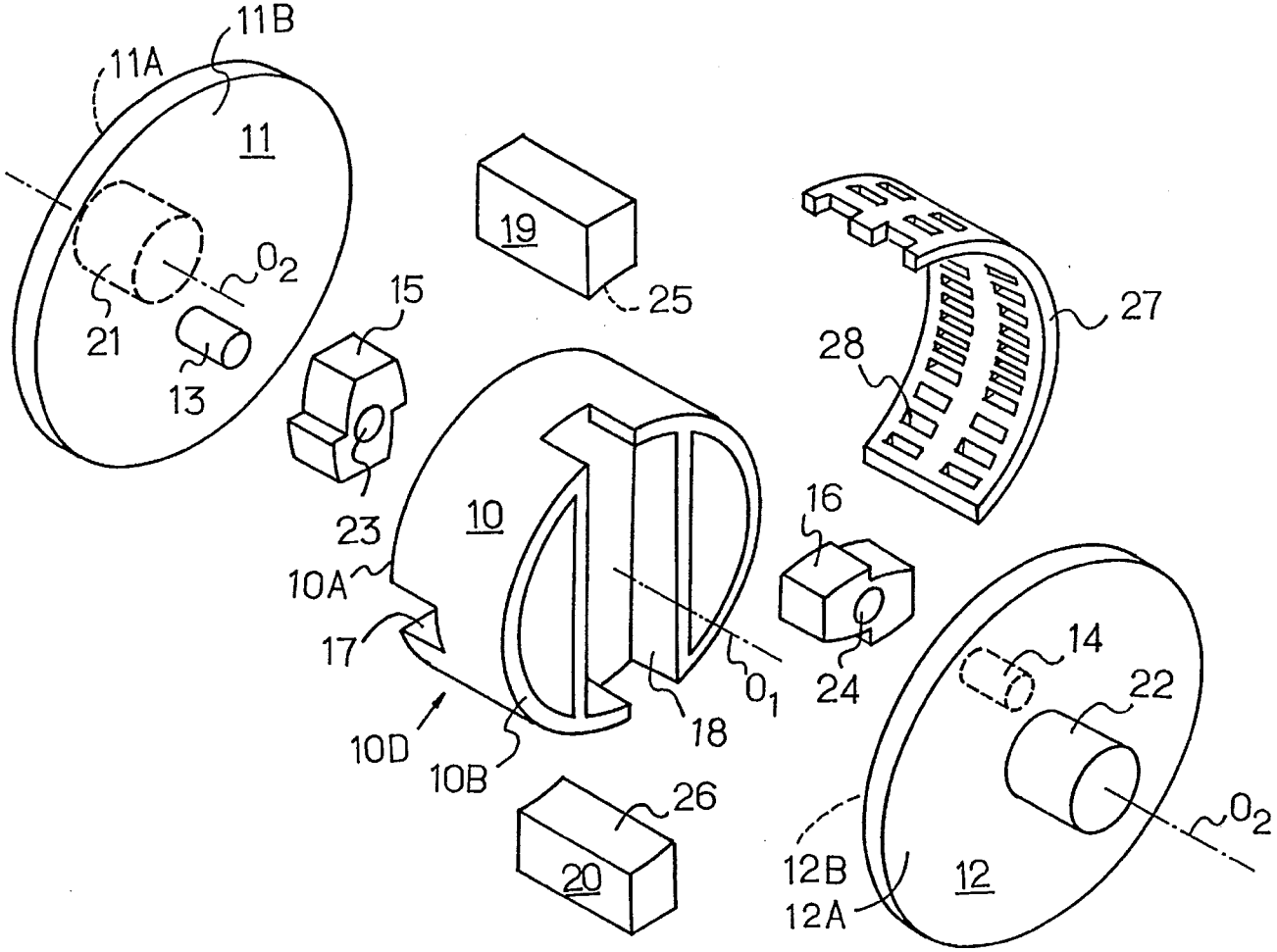
FIG. 2 is an exploded view of the major components of one embodiment of the present invention.

Each slot 17, 18 when covered with its respective disk 11, 12 becomes a cylinder 17A, 18A of a uniform cross section. In use, the faces 10A, 10B of the central rotor 10 and the pistons 15, 16 make sliding contact with the back surface 11B, 12B of the disk 11, 12, respectively. The volume of each cylinder is divided by each piston 15, 16. FIG. 2 illustrates the central rotor with a reduced mass area at both sides of the slot and may be used for lubrication. However, such mass reduction is optional as appreciated by those skilled in the art. Also, as appreciated by those skilled in the art, disks 11, 12 may be rotated by means other than providing rotational force through the center shafts 21, 22 mounted on the front surface 11A, 12A, respectively, as illustrated in FIG. 2. For example, each disk could include peripheral gear teeth and be rotated thereby.

The disk shafts 21, 22 are rotated at the same angular velocity. Either one shaft or both shafts may receive the rotational driving force. In the latter case, both center shafts 21, 22 can be connected to a parallel common driving shaft through a gear mechanism. When one center shaft, for example shaft 22 is driven, the force flows sequentially to the piston 16, to the rotor 10 and then to the other piston 15 and then to the center shaft 21. Thus the pistons exert a greater force on the slot walls when only one shaft is driven as when compared to the case that both shafts are driven. Therefore, the mechanism of driving both center shafts is preferred in order to reduce the force on the slot walls and to make a smooth drive over the "dead center" point which occurs when the axis $O_3$ of the piston is at the rotor center $O_1$.

Figure 3:
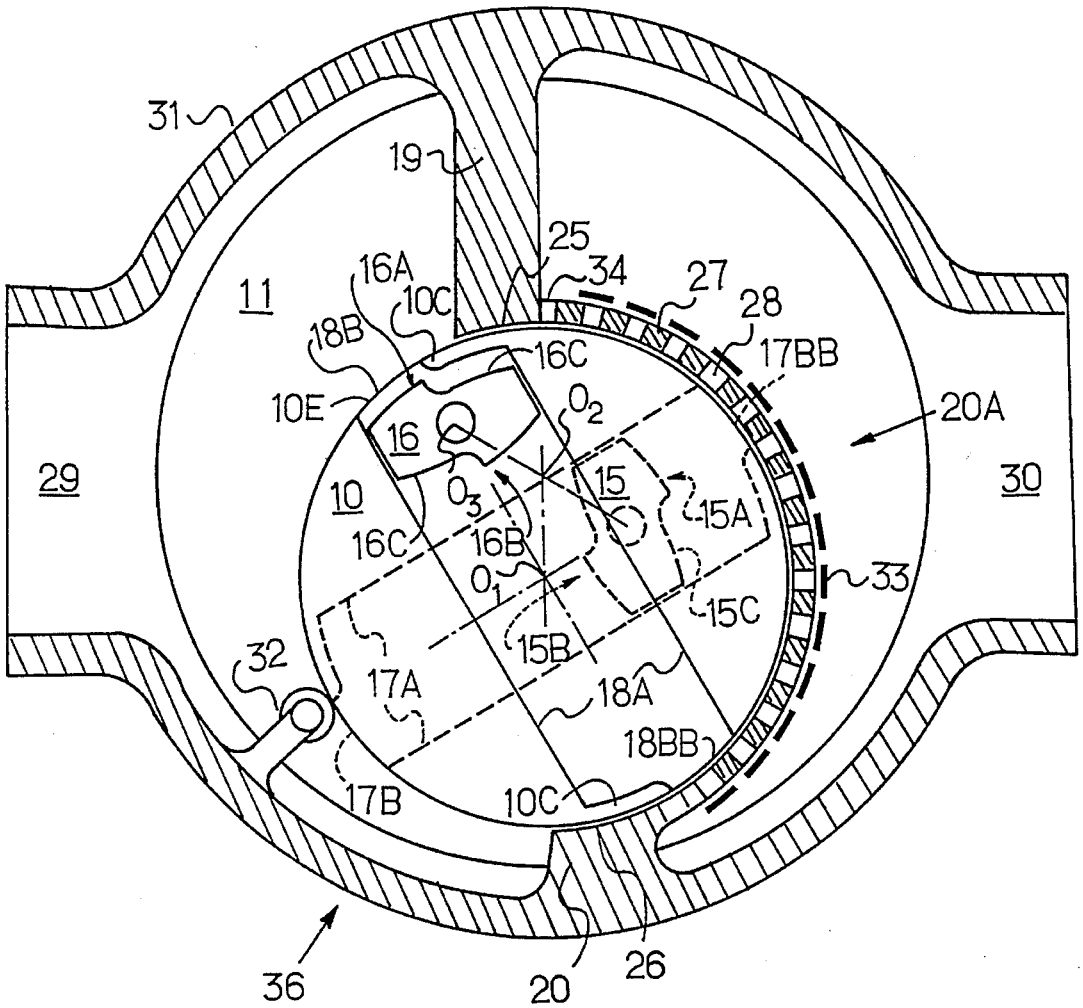
FIG. 3 is a side elevational cross sectional view of the present invention.
Figure 5:
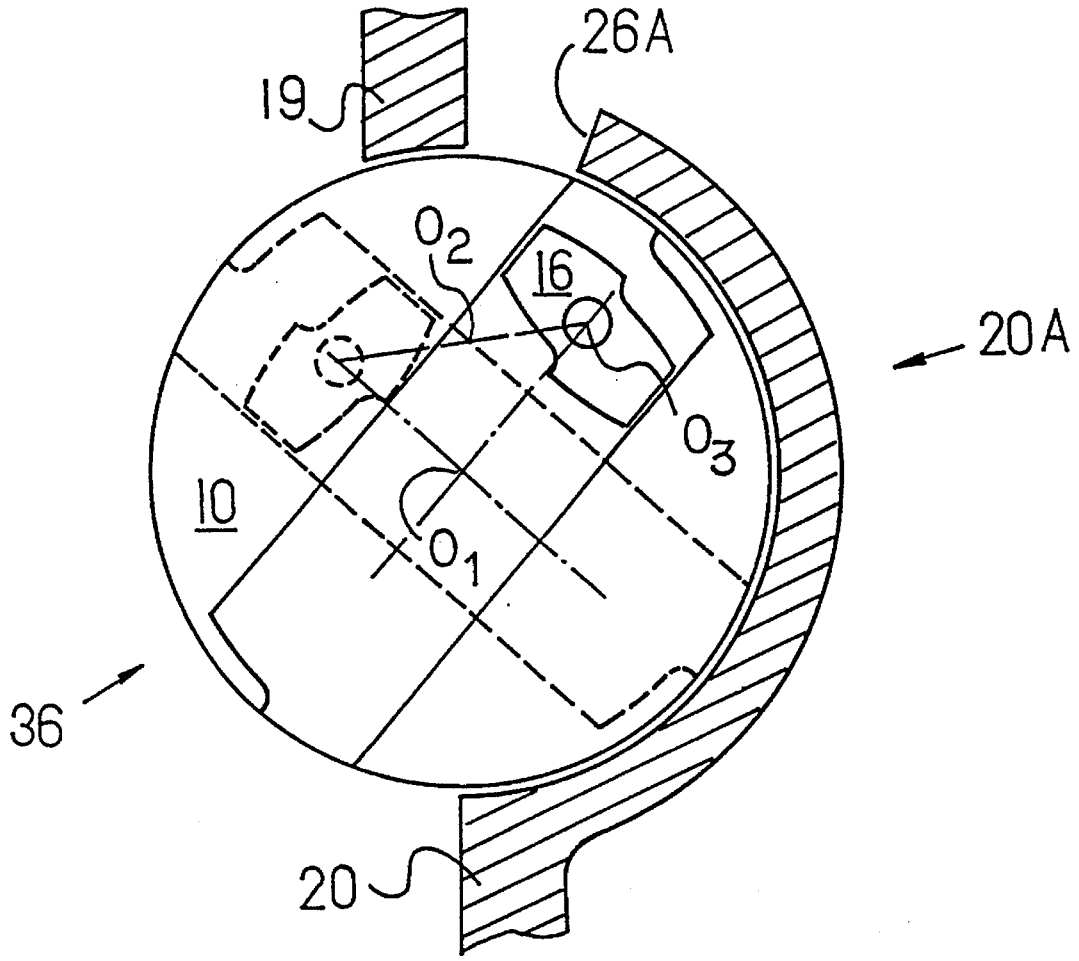
FIG. 5 is a cross sectional view of the rotor and the arced wall separating the case into an intake portion and an outlet portion for a constant ratio of compression in another embodiment of present invention.

FIG. 3 shows a side elevational cross section of the apparatus of the present invention. The front cylinder 18A in the rotor 10 is depicted in a solid line and the back cylinder 17A in a dashed line. The rotor and the cylinders rotates counterclockwise about the center $O_1$ and the pistons rotate counterclockwise about the center $O_2$ within the case 31. Thus, the inlet port 29 is the low-pressure port and the outlet port 30 is the high-pressure port. As shown, the distance between the piston center $O_3$ and the disk center $O_2$ should be equal to the distance between the disk center $O_2$ and the rotor center $O_1$, The case 31 has an arced wall 20A for dividing the case into the inlet port 29 and the outlet port 30. Preferably, the arced wall 20A includes dividing walls 19, 20. The arced wall 20A also provides rotational support for the central rotor and its components, i.e. the rotor assembly 36. The rotor assembly 36 comprises the central rotor 10 and the pistons 15, 16 in the cylinders 17A, 18A, respectively. The arced wall 20A partially receives and encloses the rotor assembly 36 therein, as illustrated in FIGS. 3 and 5. With this arced wall 20A construction, gases cannot flow between the ports 29, 30 except during operation of the rotor assembly. The arced wall 20A includes at least one opening 26A (see FIG. 5) formed therein to enable gaseous flow from the inlet port into the outlet port 30 during operation of the rotor assembly. The opening 26A is positioned along the arced wall 20A such that its position coincides with the piston being at the highest compression phase, as seen in FIG. 5.

The arced wall 20A may also include a plurality of openings, as see FIGS. 2 and 3. When the arced wall 20A includes a plurality of openings, an arc valve seat 27 with a plurality of openings 28 is defined. The arc valve seat 27 preferably includes the use of a flapping plate valve 33, as see FIG. 3.

Preferably, the arced wall is configured to enable the covering, i.e. occlusion, of the open end of the cylinder to prevent backflow from the output port to the inlet port upon further rotation of the cylinder after discharge. This is accomplished by, as illustrated in FIG. 3, providing a dividing wall 19 of the arced wall 20A with an upper wall end surface 25 having a thickness sufficient to occlude the open end of the cylinder as it rotates into gaseous communication with the inlet port after gaseous discharge into the outlet port. Thus, by obstructing any momentary gaseous communication between the inlet port and outlet port, backflow to the low pressure input port is prevented. This wall configuration enhances efficiency of the device over a similar device which allow some backflow.

As the pistons secured to the off-center shaft 13, 14 having axis $O_3$ are rotated about the axis $O_2$ in FIG. 3 by the rotating disks 11, 12, the pistons exert a force normal to the cylinder wall, which causes the central rotor to rotate about the axis $O_1$ since the normal forces bring about a moment about the rotor center except for the instant that the piston center $O_3$ coincides with the rotor axis $O_1$. No positive drive occurs at "dead center." For this instant, the inertia of the rotating rotor or an applied torque on the opposite piston maintains rotation. In the counterclockwise rotation in FIG. 3, the front piston exerts a force on the lower wall of the front cylinder, and the back piston 15 exerts a force on the upper wall of the back cylinder. As the lines of forces are apart from the rotor center, the forces generate a moment, which should be larger than a moment due to friction force between the rotor surface and case walls. Therefore, like any other machine parts having sliding contact, it is necessary to have good lubrication on all contacting surfaces of the rotor. With a single piston driven, the operation can be hard since a very large torque, applied or inertia, is required for the piston near the dead Center. Thus it is desirable to have both pistons be driven.

More specifically, in the embodiment illustrated at FIG. 3, the central rotor 10 makes sliding contact with the upper and lower wall end surfaces 25, 26 of dividing walls 19, 20, respectively, of the case 31. Preferably, the width of the arced wall and the dividing walls 19, 20, as shown in FIG. 3, are equal to the axial length of the rotor 10. The interior wall thus provides support for the entire width of the face 10D of the central rotor 10, i.e. is in sliding contact with the face 10D of the rotor in close clearance. The central rotor can be further supported by at least one rotational supporting means positioned in the intake port to rotationally support the central rotor. Such rotational support means include a single roller 31 or multiple rollers, not shown, positioned to provide rotational support to the face 10D of the central rotor 10, as see FIG. 3. That is, the peripheral rotational support of the central rotor is to decrease friction as the central rotor rotates.

For a variable compression ratio compressor, on the discharge side of the rotor, see FIG. 3, the arc valve seat 27 with the plurality of openings 28 are installed so as to be in sliding contact with the rotor face 10D. The arced flapping plate valve 33 is positioned on the arc valve seat 27 as illustrated in FIG. 3. The plate valve 33 also has a plurality of discharge openings 35, and in the closed-valve position the discharge openings 35 are not in alignment with the arc valve seat 27 plurality of openings 28, i.e. the plate valve occludes the arc valve seat 27 openings 28. Thus, arc valve seat 27 openings 28 are occluded or closed until sufficient pressure is attained in the cylinder to force the plate valve 33 away from the arc valve seat to permit flow of the pressurized gas through the plurality of openings in the arc valve seat and through the plurality of openings in the plate valve and into the outlet port 30. As the cylinder further rotates (counterclockwise) toward the upper wall 19, the pressure in the cylinder increases and the compressed gas is discharged into the outlet port. Preferably, the valve seat opening 34 next to the upper wall 19 is always open, i.e. without an occluding valve to cover it, to ensure that all the remaining pressurized gas in the cylinder may be discharged.

The maximum pressure obtainable from a compressor of the present invention is determined when all the valves are closed until the cylinder reaches the last valve seat opening 84. Therefore, for a high compression ratio, the last valve seat opening 84 is best located near the centerline connecting the points $O_1$ and $O_2$. Accordingly the dividing wall 19 in FIG. 8 is shifted a little to the left from the centerline $O_1O_2$ as shown. Preferably, when the cylinder axis is vertical, parallel to the centerline $O_1O_2$, the piston should be at the outer edge 10E of the rotor 10, closing the cylinder entrance and contacting the end surface 25 of the dividing wall in close clearance, for which the cylinder entrance may, preferably, have a partial cover 10C with the heads of the piston configured, i.e. offset, to receive the partial cover 10C of the cylinder. That is, each open end 17B, 17BB and 18B, 18BB of each cylinder further includes a partial cover 10C and each piston further includes a first end 15A, 16A and a second end 15B, 16B with a depression 15C, 16C formed at each first and second ends, respectively, to receive the partial cover 10C therein. This configuration adjustment is carried out to increase of compression ratio and cylinder volume and is optional. When the piston is in close contact (piston position at maximum compression) with the upper wall end surface 25, the cylinder should be closed at the lower end by the wall end surface 26, which is a little shifted to the right from the centerline $O_1O_2$. Thus the cylinder has a 180-degree rotational symmetry.

FIGS. 4A–4D show relative positions in operation of the piston and rotor in counterclockwise rotation, with the front cylinder (i.e. "closest" to the viewer of the FIGS. as a solid line and the back cylinder (set behind the front cylinder and "furthest" from the viewer) as a dashed line, having non-intersecting axes of rotational symmetry to each other. The off-center shaft axis $O_3$ rotates about the center $O_2$ and the cylinder rotates about the center $O_1$, and the distance $O_2O_3$is equal to the distance $O_1O_2$. When the front cylinder is in 90-degree rotational symmetry to the back cylinder, each off-center shaft axis $O_3$ is symmetrical about the point $O_2$.

Figure 4A:
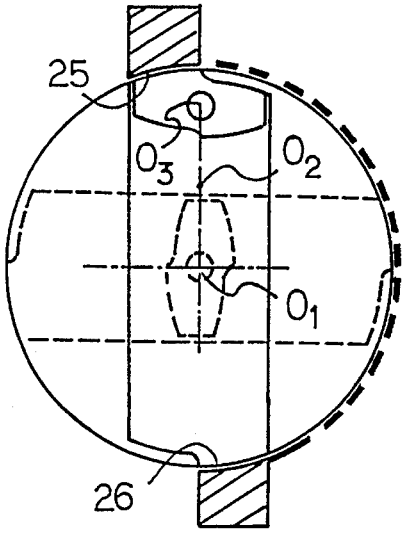
FIGS. 4A–4D show the relative positions of the piston and cylinder for one revolution of the disk.

In FIG. 4A, the vertical front cylinder (in solid lines) is filled with suctioned gas, and the horizontal back cylinder (in broken lines) also contains suctioned gas to the left of the piston and compressed gas to the right of the piston. The stroke length ST is twice the the length $O_1O_3$.

Figure 4B:
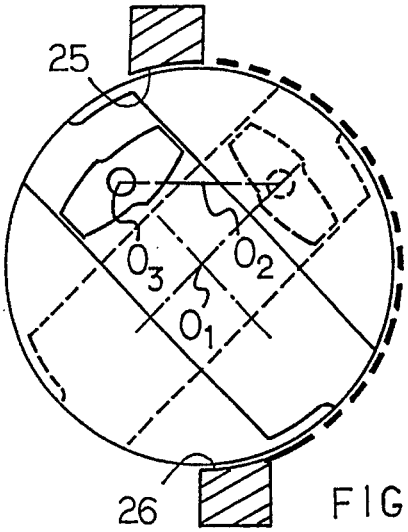

FIG. 4B illustrates the cylinders upon further rotation of 90-degrees of disks 11, 12 about $O_2$. During this time each cylinder rotates 45 degrees and each piston also moves with respect to the cylinder. Gas flows into each of the cylinder spaces in gas communication with the input port due to the suction created by the piston traveling in the respective cylinders, i.e. to the cylinder to the left of each piston. In like manner, the gases on the opposite side of the piston (the right side of the piston in FIGS. 4A–4D are pressurized/compressed due to the decreased volume of the cylinder caused by the piston traveling in the respective cylinders.

Figure 4C:
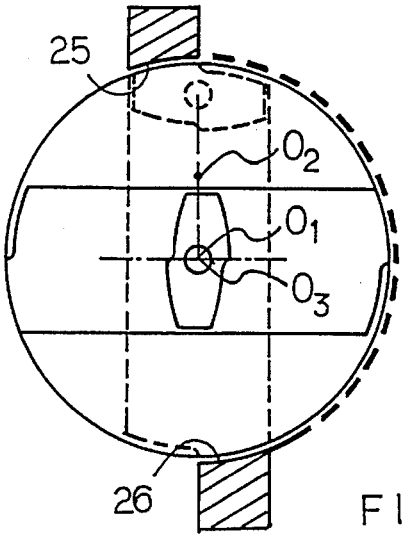
Figure 4D:
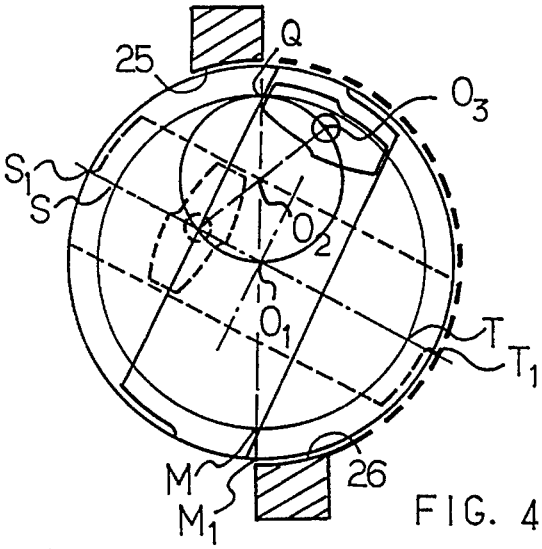

FIG. 4C illustrates the cylinders upon further, 90-degrees, rotation of disks 11, 12 about $O_2$, in which the gas of the horizontal front cylinder is half suctioned and half compressed, and the vertical back cylinder completes its suction and begins compression. The position of the vertical back cylinder may also correspond to the end of compressive discharge and the beginning of suction. The wall ends 25, 26 are configured to cover the open ends of the cylinder to prevent backflow. The angular position of the front cylinder in FIG. 4C is equal to that of the back cylinder in FIG. 4A. Thus, 180-degree rotation of the disk about $O_2$ from FIG. 4C brings forth the 90-degree rotation of the cylinder to the position of FIG. 4A. In summary, the 360-degree rotation of the disk results in a 180-degree rotation of the cylinder, which constitutes one cycle of compression. FIG. 4D with all its valves closed shows the position of the front cylinder in maximum compression ratio, in which the compressed gas begins to flow out through the last opening 34 of the valve seat 27.

Furthermore, FIG. 4D illustrates the spatial relationship of the claimed elements of the present invention. Here the diagram of the plane kinematics utilized in the present invention is combined with a sectional view to clearly present the linear relationships among the elements of the present invention. In the FIG. 4D, the points S, T are the farthest position from the rotor center $O_1$ to which the off-center shaft 13, 14 axis travels. As they are in an equal distance from the rotor center $O_1$, ST is the diameter of a large circle in the kinematics diagram. The rotor has an outer diameter $S_1T_1$ which is greater than ST by the piston length to the direction of slot axis. The center $O_2$ of each disk 11, 12 is positioned eccentrically to the rotor center $O_1$ in the quarter of the length ST. The off-center shaft rotates about the disk center $O_2$, defining the small circle in the kinematics diagram. The straight line connecting the point $O_1$ and the point $O_2$ is extended to intersect the large circle of the kinematics diagram at the points Q, M and the peripheral circle of the rotor at the point $M_1$. The points $S_1$,$M_1$,$T_1$ and Q are on the periphery of the rotor. Thus, $O_1O_2=O_2O_3=\frac{1}{2}O_1Q=\frac{1}{4}ST$. Each disk 11, 12 must have a radius greater than $O_2M_1$ to cover the open side of the slot at all positions.

In the figure:

1. ST is stroke length of the diameter of a large circle in the kinematics diagram;
2. $S_1T_1$ is the diameter of the central rotor 10;
3. $O_1O_2$ is the distance between the axis $O_1$ of the central rotor 10 and the axis $O_2$ of the disk 11 and/or 12;
4. $O_2O_3$ is the distance between the axis $O_2$ of the disk 11 and/or 12 and the axis $O_3$ of the off-center shaft 13, 14 (also referred to as the "piston center");

5. ½$O_1Q$ is one-half the distance between the axis $O_1$ of the central rotor 10 and Q (Q is the contacting point as see FIG. 1); and 6. ¼ST is one fourth the stroke length.

FIG. 5 is a side elevational cross sectional view of another embodiment of present invention for the compression of gases illustrating the rotor 10 and the dividing walls 19, 20 and arced wall 20A of the housing for a constant ratio of compression in the compressor with counterclockwise rotation. The complete housing and disks are not shown to simplify the figure. In this embodiment, the arc valve seat 27 and the flapping plate valve are not used. The front cylinder shown in solid lines is about to discharge the compressed gas into the output port through the opening 26A. As appreciated by one skilled in the art, the rotor 10 and the arced wall 20A of the casing 31 are in sliding contact so as to aid in the retention of the gas during the compressing phase, i.e. piston travel toward the dividing wall 20. The total suctioned volume is divided by the discharge volume to determine the compression ratio.

Figure 6:
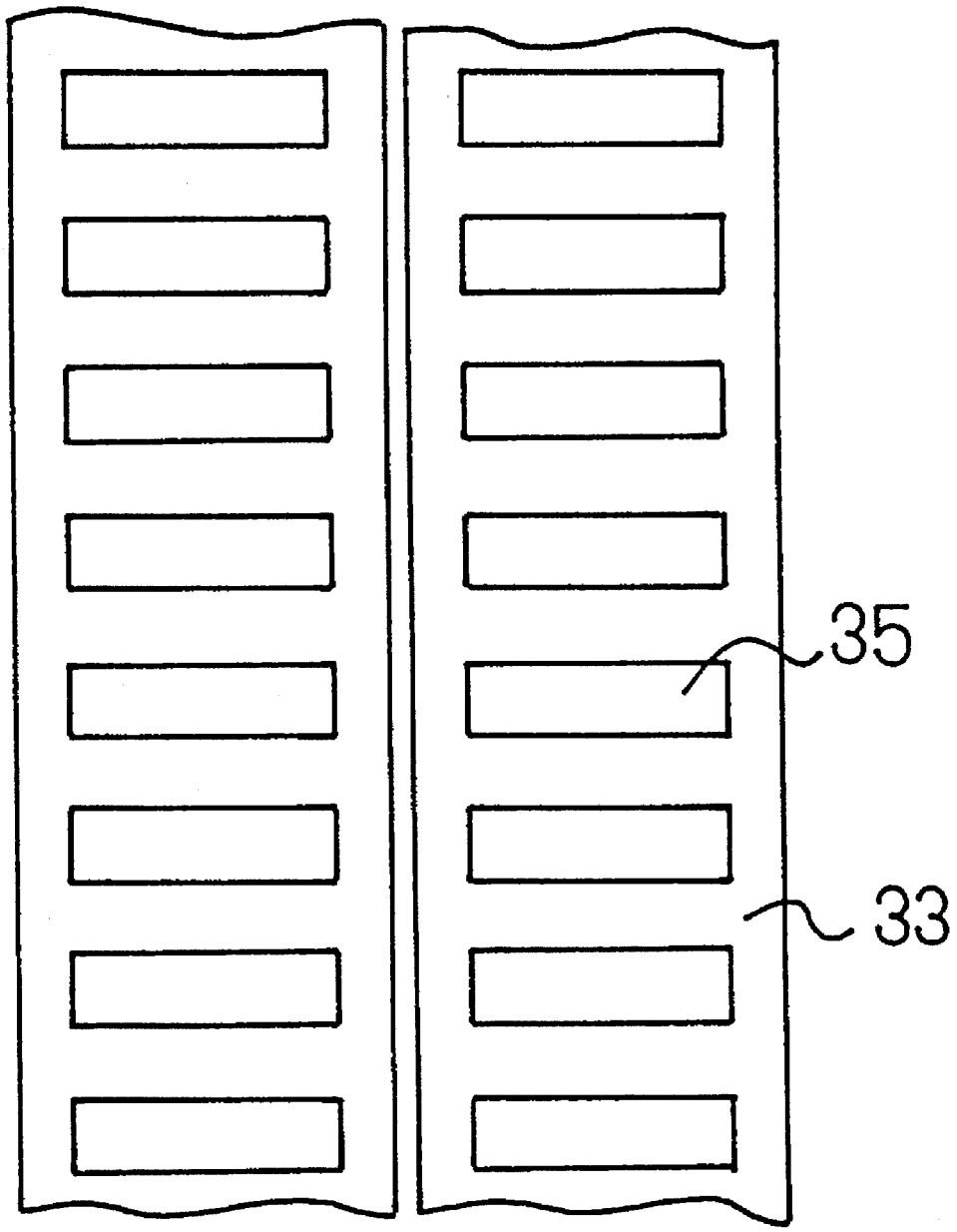
FIG. 6 is a partial view of the flapping plate valve according to the present invention.

FIG. 6 shows a portion of the flapping plate valve 33 having circular arc shape to be seated upon the arc valve seat 27, as illustrated in FIG. 3. The plurality of valve openings 35 are located in a manner so as to occlude the plurality of valve seat openings 28 of the arc valve seat 27. The flapping plate valve 33 may be hinge-connected onto the valve seat or loosely placed on the valve seat with a small clearance for flapping or opening under a pressure increase or discharge. A tensioning means such as a spring can be used for holding the plate valve in the closed position except for the period of discharge.

The compressor of the present invention has several features of marked distinction. Like double-acting reciprocating compressors, the suction and compression take place on each side of the piston, which doubles the compression volume for a given cylinder size. Moreover, all the moving elements are in rotation and no parts are in linear motion with respect to the absolute reference frame. As a consequence, operation can be quiet compared to the reciprocating compressors. The unbalanced mass is minimized only to the piston mass. Leakage can be also minimized in this invention since the high-pressure spaces are separated from the low-pressure spaces by contact surfaces rather than contact lines as in the other rotary compressors. It is noted that the compressor becomes a vacuum pump when the inlet port 29 is connected to a vacuum cylinder and the outlet port 30 is connected to a discharge port.

Figure 7A:
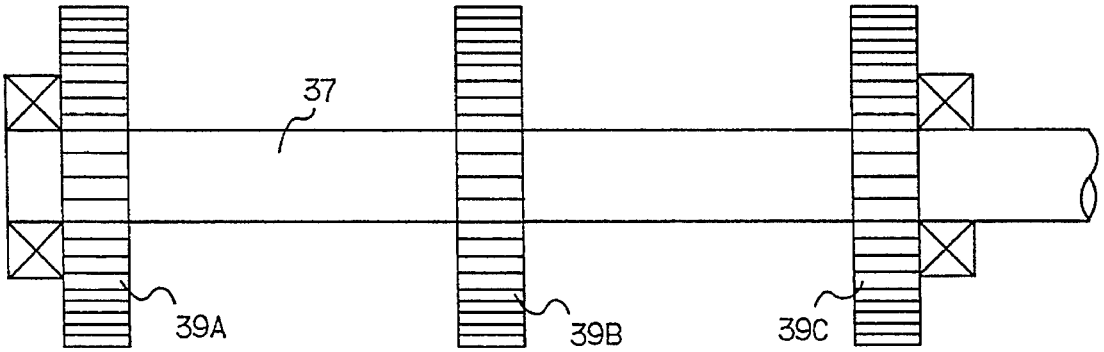
FIG. 7A is a view of a drive shaft with driving gears mounted thereon for use with adjacent rotor assemblies.

FIG. 7A illustrates a drive shaft 37 with driving gears 39A, 39B, 39C mounted thereon to provide rotational input to each rotor assembly of a plurality of rotor assemblies 41, respectively.

Figure 7B:
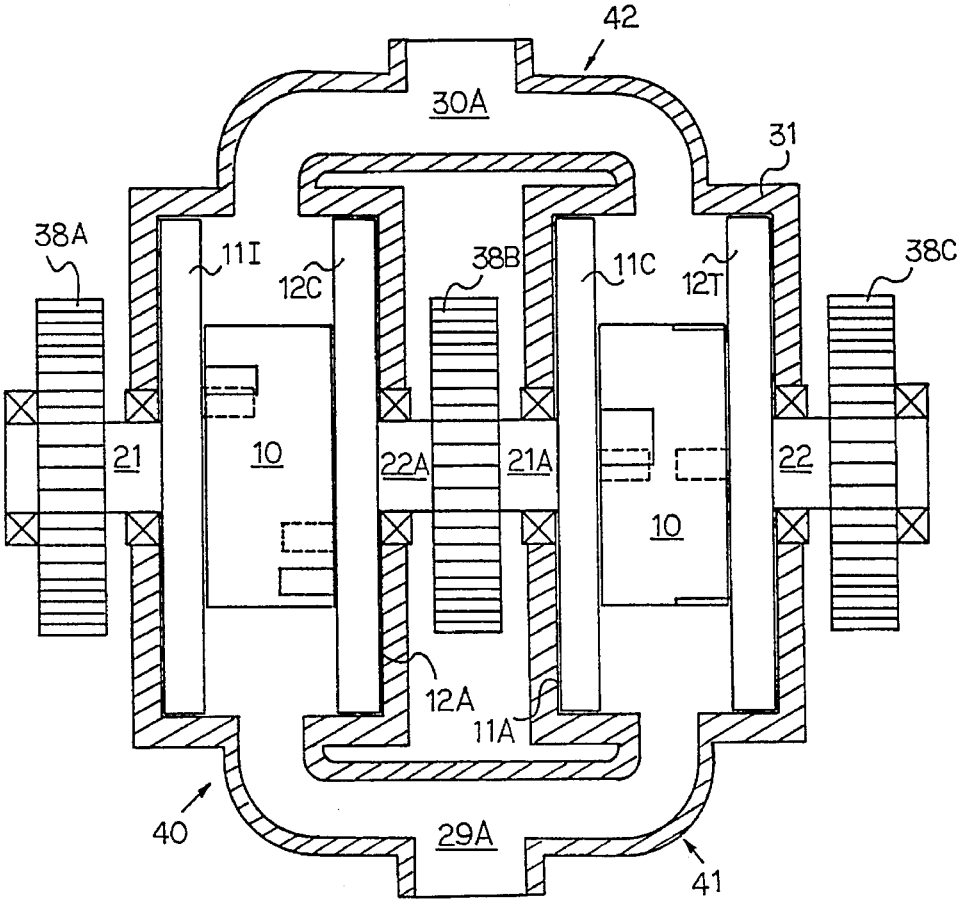
FIG. 7B is a top partial sectional view of adjacent rotor assemblies according to the present invention.

FIG. 7B is a top view of a plurality of juxtaposed rotor assemblies 40 connected in parallel according to the present invention. In FIG. 7B the arced wall 20A is not shown for a clear view of the rotor assemblies. Positive displacement type compressors produce pulsating or intermittent flow. In order to minimize flow pulsation, a plurality of compressors 40 according to the present invention can be connected in parallel and configured to discharge into the outlet port at different times.

Thus, in this embodiment each adjacent disk 11C, 12C includes a center shaft 21A, 22A axially mounted on the front surface 11A, 12A of each disk, respectively. The center shafts 21A, 22A are mounted to a gear 38B therebetween. The rotor assemblies 40 are operatively positioned in the case 31 and operatively connected to a common inlet port 29A and a common outlet port 30A of the case 31 as illustrated at FIG. 7B. Preferably, the adjacent rotors have a differing phase of rotation, for example, the left rotor in FIG. 7B is in the rotational phase of FIG. 4B while at the same time the right rotor is in the rotational phase of FIG. 4C. Each gear 38A, 38C to receive rotational input may be mounted on each center shaft 21, 22 of the initial disk 11I and terminal disk 12T of the rotor assemblies, respectively. Interconnecting means 42 for coupling together opposing center shafts 21A, 22A of adjacent rotor assemblies assemblies 41 of the plurality of rotor assemblies 40 and which receives rotational input and transmits rotational input are utilized.

Preferably, a means for providing rotational input to the interconnecting means of adjacent rotor assemblies 41 is used. Such means includes driving gears 39A–39C(FIG. 7A) and driven gears 38A–38C(FIG. 7B) being in a meshed state, not shown, or being linked by a timing belt, not shown. Such means are well known to those skilled in the related art. That is, each center shaft receives rotational input and transmits it to the respective disk through respective gears 38A, 38B and 38C, as illustrated at FIG. 7B. This construction provides for the smoothest operation and reduces the force acting on the cylinder by the driven piston. However, rotational input can also be applied to only one of the center shafts, e.g. to only gear 38A on the shaft 21, with the remaining center shaft of that rotor assembly transmitting the rotational input to the adjacent rotor assembly.

The apparatus for pumping or compressing gases of the present invention may also comprises a single cylinder rather than the two cylinders described above. In this case a central rotor 10 has a rotational axis $O_1$, a first face 10A and a second face 10B with an open ended slot 17 formed perpendicular to the axis in the first face 10A. The first disk 11 has a rotational axis $O_2$ spaced apart and parallel to the rotational axis $O_1$ of the central rotor 10, a front surface 11A and a back surface 11B with the back surface 11B which is in sliding contact with the first face 10A such that the open-ended slot defines an open-ended cylinder 17A. The first off-center shaft 13 eccentrically positioned on the back surface 11B of the disk 11 and with the off-center shaft has an axis $O_3$ which is spaced apart and parallel to the respective rotational axis $O_2$ of the first disk 11. The second face 10B of the rotor may be just a flat surface in sliding contact with the back surface 12B of the second disk 12. A driving shaft may be connected directly to the front face 11A of disk, with the driving shaft axis being coaxial to the disk axis $O_2$. Only a single piston, i.e. the first piston 15, is needed. The piston 15 has a bore 23 formed therein for receiving the off-center shafts 13 formed on the back surface 11B of the first disk with the first piston being slidably received into the cylinder 17A to permit the piston to travel a stroke length within the cylinder and rotate about the axis $O_2$ of the disk, to thereby define a rotor assembly wherein a distance between the disk axis $O_2$ and the rotor axis $O_1$ is equal to a distance between the off-center axis $O_3$ and the disk axis $O_2$. The case 31 has an arced wall 20A which divides the case into an inlet port 29 and an outlet port 30 and rotationally supports and partially encloses the rotor assembly. The arced wall 20A further includes at least one opening formed therein to enable gas flow into the outlet port, such that upon rotation of the disk about axis $O_2$, the central rotor is rotated about axis $O_1$ to expose the open end of the cylinder to the intake port whereat the piston moves within the cylinder to enable withdrawal of gas from the intake port 29 into the cylinder and upon further rotation of the central rotor, the arced wall covers the open end of the cylinder exposed to the intake port and the piston moves to compress the gas within the cylinder to a pressure of a constant compression ratio and upon further rotation, moving the cylinder to the opening formed in the arced wall to enable the compressed gas to be discharged through the opening in the arced wall and into the output port.

In another embodiment the above described one cylinder apparatus is modified so that the arced wall further includes a plurality of openings 28 formed therein to define an arc valve seat 27 to enable gas flow into the outlet port. A flapping plate valve 33 having plurality of openings 35 formed therein is also used. The flapping plate valve 33, in use, is in pressured contact with the arc valve seat 27 of the arced wall 20A and occludes the plurality of openings formed in the arc valve seat 27. Thus, upon rotation of the disk, the central rotor is rotated to expose the open end of the cylinder to the intake port to enable the piston to move within the cylinder to enable withdrawal of gas from the intake port 29 into the cylinder and upon further rotation of the central rotor, covering the open end of the cylinder exposed to the intake port and moving the piston to compress the gas within the cylinder to a pressure greater than existing pressure of the outlet port 30 thereby forcing the flapping plate valve 33 to move away from the arc valve seat 27 causing the compressed gas to pass through the plurality of openings formed in the flapping plate valve and into the outlet port. Preferably, the arced wall 20A is configured, i.e. having a terminal thickness at least as thick as the open end of the cylinder, so that upon further rotation the arced wall 20A covers the open end of the cylinder to prevent back flow from the output port to the inlet port. Also, in the multi cylinder embodiment, the arced wall is prefably configured to enable the covering of the open end of the cylinder to prevent backflow from the output port to the inlet port upon further rotation of the cylinder after discharge. This is accomplished by, as illustrated in FIG. 3, providing a dividing wall 19 of the arced wall 20A with an upper wall end surface 25 thickness sufficient to occlude the open end of the cylinder as it rotates into gaseous communication with the inlet port after discharge in the outlet port. That is, by obstructing any momentary gaseous communication between the inlet port and outlet port, backflow is prevented.

Thus far, even though the concept of the present invention is illustrated with its embodiment, there can be many other variations in the design of the compressors while complying the spirit of the present invention. The positive displacement type compressors produce intermittent flow, so in order to reduce pulsation the number of cylinders in parallel arrangement can be increased. In the multiple-cylinder compressors, the shafts of the disk can be connected to a parallel common driving shaft through a gear mechanism. The force between piston and cylinder wall can be reduced with each disk driven by a driving shaft. The cross section of the piston and cylinder may have a shape other than the rectangle which is illustrated in FIG. 2.

What is claimed is:

1. An apparatus for pumping or compressing gases comprising:

a central rotor (10) having a rotational axis $O_1$, a first face (10A) and a second face (10B) with an open-ended slot (17, 18) formed perpendicular to said axis in each said face (10A, 10B);

a first disk (11) and a second disk (12) with each said disk having a rotational axis $O_2$ spaced apart and parallel to said rotational axis $O_1$ of said central rotor (10), a front surface (11A, 12A) and a back surface (11B, 12B) and each said back surface (11B, 12B) of each said disk (11, 12) in sliding contact with said first face (10A) and said second face (10B) of said central rotor (10), respectively, such that each said open-ended slot defines an open-ended cylinder (17A, 18A);

a first and a second off-center shaft (13, 14) eccentrically positioned on said back surface (11B, 12B) of each said disk (11, 12), and with each said off-center shaft having an axis $O_3$ spaced apart and parallel to said respective rotational axis $O_2$ of said first and said second disk, respectively;

a first piston (15) and a second piston (16) with a bore (23, 24) formed in each said piston for receiving therein one of said off-center shafts (13, 14) formed on said back surface (11B, 12B) of said first and said second disk, respectively, with each said first and said second piston being slidably received into each said cylinder (17A, 18A) to permit each said piston to travel a stroke length within said cylinder and rotate about said axis $O_2$ of each said disk, respectively, to thereby define a rotor assembly (36) wherein a distance between said disk axis $O_2$ and said rotor axis $O_1$ is equal to a distance between said off-center axis $O_3$ and said disk axis $O_2$; and a case (31) having an arced wall (20A) for dividing said case into an inlet port (29) and an outlet port (30) with said arced wall rotationally supporting and partially enclosing said rotor assembly (36) and having at least one opening (26A) formed therein to enable gas flow into said outlet port, such that upon rotation of at least one of said disks about axis $O_2$, said central rotor is rotated about axis $O_1$ to expose one of said open ends of said corresponding cylinder to said intake port whereat said corresponding piston moves within said cylinder to enable withdrawal of gas from said intake port (29) into said cylinder and upon further rotation of said central rotor, said arced wall covers said open end of said cylinder exposed to said intake port and said piston moves to compress said gas within said cylinder to a pressure of a constant compression ratio and upon further rotation, moving said cylinder to said opening formed in said arced wall and to enable said compressed gas to be discharged through said opening (26A) in said arced wall and into said output port.

2. The apparatus of claim 1 wherein each said disk further includes a center shaft (21, 22) axially mounted on said front surface (11A, 12A) of each said disk, respectively, to receive rotational input.

3. The apparatus of claim 1 wherein said central rotor (10) is additionally rotationally supported by at least one roller (32) positioned in said intake port.

4. The apparatus of claim 1 wherein said slots (17, 18) formed on each side of said central rotor (10) are perpendicularly formed in said central rotor.

5. The apparatus of claim 1 wherein each said open end (17B, 17BB) and (18B, 18BB) of each said cylinder further includes a partial cover (10C) and each said piston further includes a first end (15A, 16A) and a second end (15B, 16B) with a depression (15C, 16C) formed at each said first and second end, respectively, to receive said partial cover (10C).

6. The apparatus of claim 1 further including a plurality of rotor assemblies (40) with each rotor assembly (36) operatively positioned in said case (31) and operatively connected to a common inlet port (29A) and a common outlet port (30A) of said case (31);

each adjacent disk (11C, 12C) of adjacent rotor assemblies (41) of said plurality of rotor assemblies (40) further includes a center shaft (21A, 22A) axially mounted on said front surface (11A, 12A) of each said adjacent disk, respectively, to receive rotational input; and interconnecting means (42) for coupling said center shafts (21A, 22A) of adjacent rotor assemblies (41) of said plurality of rotor assemblies (40) to receive and transmit rotational input therethrough.

7. An apparatus for pumping or compressing gases comprising:

a central rotor (10) having a rotational axis $O_1$, a first face (10A) and a second face (10B) with an open-ended slot (17, 18) formed perpendicular to said axis in each said face (10A), (10B);

a first disk (11) and a second disk (12) with each said disk having a rotational axis $O_2$ spaced apart and parallel to said rotational axis $O_1$ of said central rotor (10), a front surface (11A, 12A) and a back surface (11B, 12B) and each said back surface (11B, 12B) of each said disk (11, 12) in sliding contact with said first face (10A) and said second face (10B) of said central rotor (10), respectively, such that each said open-ended slot defines an open-ended cylinder (17A, 18A);

a first and a second off-center shaft (13, 14) eccentrically positioned on said back surface (11B, 12B) of each said disk (11, 12), and with each said off-center shaft having an axis $O_3$ spaced apart and parallel to said respective rotational axis $O_2$ of said first and said second disk, respectively;

a first piston (15) and a second piston (16) with a bore (23, 24) formed in each said piston for receiving therein one of said off-center shafts (13, 14) formed on said back surface (11B, 12B) of said first and said second disk, respectively, with each said first and said second piston being slidably received into each said cylinder (17A, 18A) to permit each said piston to travel a stroke length within said cylinder and rotate about said axis $O_2$ of each said disk, respectively, to thereby define a rotor assembly 36 wherein a distance between said disk axis $O_2$ and said rotor axis $O_1$ is equal to a distance between said off-center axis $O_3$ and said disk axis $O_2$;

a case (31) having an arced wall (20A) for dividing said case into an inlet port (29) and an outlet port (30) with said arced wall rotationally supporting and partially enclosing said rotor assembly (36) and with said arced wall further including an arc valve seat (27) having a plurality of openings (28) formed therein to enable gas flow into said outlet port; and a flapping plate valve (33) having plurality of openings (35) formed therein and, in use, in pressured contact with said arc valve seat (27) of said arced wall (20A) to occlude said plurality of openings formed in said arc valve seat (27) such that upon rotation of at least one of said disks, said central rotor is rotated to expose one of said open ends of said cylinder to said intake port to enable said corresponding piston to move within said cylinder to enable withdrawal of gas from said intake port (29) into said cylinder and upon further rotation of said central rotor, covering said open end of said cylinder exposed to said intake port and moving said piston to compress said gas within said cylinder to a pressure greater than existing pressure of said outlet port (30) thereby forcing said flapping plate valve (33) to move away from said arc valve seat (27) causing said compressed gas to pass through said plurality of openings formed in said flapping plate valve and into said outlet port.

8. The apparatus of claim 7 wherein each said disk further includes a center shaft (21, 22) axially mounted on said front surface (11A, 12A) of each said disk, respectively, to receive rotational input.

9. The apparatus of claim 7 wherein said central rotor (10) is additionally rotationally supported by at least one roller (32) positioned in said intake port.

10. The apparatus of claim 7 wherein said slots (17, 18) formed on each side of said central rotor (10) are perpendicularly formed in said central rotor.

11. The apparatus of claim 7 wherein each said open end (17B, 17BB) and (18B, 18BB) of each said cylinder further includes a partial cover (10C) and each said piston further includes a first end (15A, 16A) and a second end (15B, 16B) with a depression (15C, 16C) formed at each said first and second end, respectively, to receive said partial cover (10C).

12. The apparatus of claim 7 further including a plurality of rotor assemblies (41) with each rotor assembly (36) operatively positioned in said case (31) and operatively connected to a common inlet port (29A) and a common outlet port (30A) of said case (31);

each adjacent disk (11C, 12C) of said plurality of rotor assemblies (40) further includes a center shaft (21A, 22A) axially mounted on said front surface (11A, 12A) of each said adjacent disk, respectively, to receive rotational input; and interconnecting means (42) for coupling said center shafts (21A, 22A) of adjacent rotor assemblies (41) of said plurality of rotor assemblies (40) to receive and transmit rotational input therethrough.

13. An apparatus for pumping or compressing gases comprising:

a central rotor (10) having a rotational axis $O_1$, a first face (10A) and a second face (10B) with an open-ended slot (17) formed perpendicular to said axis in said first face (10A);

a first disk (11) having a rotational axis $O_2$ spaced apart and parallel to said rotational axis $O_1$ of said central rotor (10), a front surface (11A) and a back surface (11B) with said back surface (11B) in sliding contact with said first face (10A) such that said open-ended slot defines an open-ended cylinder (17A);

a first off-center shaft (13) eccentrically positioned on said back surface (11B) of said disk (11) and with said off-center shaft having an axis $O_3$ spaced apart and parallel to said respective rotational axis $O_2$ of said first disk;

a first piston (15) with a bore (23) formed therein for receiving therein said off-center shaft (13) formed on said back surface (11B) of said first disk with said first piston being slidably received into said cylinder (17A) to permit said piston to travel a stroke length within said cylinder and rotate about said axis $O_2$ of said disk, to thereby define a rotor assembly wherein a distance between said disk axis $O_2$ and said rotor axis $O_1$ is equal to a distance between said off-center axis $O_3$ and said disk axis $O_2$; and a case (31) having an arced wall (20A) for dividing said case into an inlet port (29) and an outlet port (30) with said arced wall rotationally supporting and partially enclosing said rotor assembly and having at least one opening (26A) formed therein to enable gas flow into said outlet port, such that upon rotation of said disk about axis $O_2$, said central rotor is rotated about axis $O_1$ to expose said open end of said cylinder to said intake port whereat said piston moves within said cylinder to enable withdrawal of gas from said intake port (29) into said cylinder and upon further rotation of said central rotor, said arced wall covers said open end of said cylinder exposed to said intake port and said piston moves to compress said gas within said cylinder to a pressure of a constant compression ratio and upon further rotation, moving said cylinder to said opening formed in said arced wall and to enable said compressed gas to pass through said opening (26A) in said arced wall partially enclosing said rotor assembly and into said output port.

14. The apparatus of claim 13 wherein said first disk (11) further includes a center shaft (21) axially mounted on said front surface (11A) of said disk to receive rotational input.

15. The apparatus of claim 13 wherein said central rotor (10) is additionally rotationally supported by at least one roller (32) positioned in said intake port.

16. The apparatus of claim 13 wherein said open end (17B, 17BB) of said cylinder further includes a partial cover (10C) and said piston further includes a first end (15A) and a second end (15B) with a depression (15C) formed at said first and second end, respectively, to receive said partial cover (10C).

17. The apparatus of claim 13 wherein said arced wall further includes a plurality of openings (28) formed therein to define an arc valve seat (27) to enable gas flow into said outlet port; and a flapping plate valve (33) having plurality of openings (35) formed therein and, in use, in pressured contact with said arc valve seat (27) of said arced wall (20A) to occlude said plurality of openings formed in said arc valve seat (27) such that upon rotation of said disk, said central rotor is rotated to expose said open end of said cylinder to said intake port to enable said piston to move within said cylinder to enable withdrawal of gas from said intake port (29) into said cylinder and upon further rotation of said central rotor, covering said open end of said cylinder exposed to said intake port and moving said piston to compress said gas within said cylinder to a pressure greater than existing pressure of said outlet port (30) thereby forcing said flapping plate valve (33) to move away from said arc valve seat (27) causing said compressed gas to pass through said plurality of openings formed in said flapping plate valve and into said outlet port.

18. The apparatus of claim 17 wherein said first disk (11) further includes a center shaft (21) axially mounted on said front surface (11A) of said disk to receive rotational input.

19. The apparatus of claim 17 wherein said central rotor (10) is additionally rotationally supported by at least one roller (32) positioned in said intake port.

20. The apparatus of claim 17 wherein said open end (17B, 17BB) of said cylinder further includes a partial cover (10C) and said piston further includes a first end (15A) and a second end (15B) with a depression (15C) formed at said first and second end, respectively, to receive said partial cover (10C).

* * * * *